US006273174B1

(12) United States Patent
Singleton

(10) Patent No.: US 6,273,174 B1
(45) Date of Patent: Aug. 14, 2001

(54) GARAGE DOOR OPENER SECURITY SYSTEM

(76) Inventor: Rick Singleton, 4 Coralberry Dr., Newark, DE (US) 19702

( * ) Notice: Subject to any disclaimer, the term of this patent is extended or adjusted under 35 U.S.C. 154(b) by 0 days.

(21) Appl. No.: 09/534,267

(22) Filed: Mar. 24, 2000

(51) Int. Cl.[7] ..... E05D 15/16
(52) U.S. Cl. ..... 160/201; 160/188
(58) Field of Search ..... 160/201, 188; 292/DIG. 2, DIG. 36, 346; 16/412; 70/54, 55, 56; 248/551

(56) References Cited

U.S. PATENT DOCUMENTS 1,495,373 * 5/1924 Witten .
3,414,306 * 12/1968 Bernstein .
3,788,688 * 1/1974 Chandler .
3,996,591 12/1976 Hayward ..... 343/225
4,598,941 * 7/1986 Nelson .
4,750,294 6/1988 Lafontaine ..... 49/28
4,813,305 3/1989 Dilich ..... 74/581
4,900,294 2/1990 Schneeberger ..... 474/167
5,010,688 * 4/1991 Dombrowski et al. .
5,477,710 * 12/1995 Stefanutti .
5,533,561 7/1996 Forehand, IV ..... 160/188
5,737,946 * 4/1998 Sole et al. .
5,875,659 * 3/1999 Nosse .
6,065,314 * 5/2000 Nicholson .

* cited by examiner

*Primary Examiner*—Blair M. Johnson
(74) *Attorney, Agent, or Firm*—Goldstein Law Offices, P.C.

(57) ABSTRACT

A garage door opener security system, for preventing the unauthorized opening of a garage door, mounted within a dwelling. The garage door opener has a track mounted to the dwelling, and a truck slidably mounted on the track which is operatively engaged with the door. A release lever extends downward from the truck to allow manual release and opening of the garage door. The security system prevents unauthorized operation of the release lever by providing a pair of security plates which extend downward from the truck on either side of the release lever. The security plates thereby prevent an unauthorized person from extending an object into the garage from outside in an attempt at operating the release lever.

3 Claims, 2 Drawing Sheets

GARAGE DOOR OPENER SECURITY SYSTEM

BACKGROUND OF THE INVENTION

The invention relates to a garage door opener security system. More particularly, the invention relates to a system for preventing unauthorized entry into a dwelling by manipulating the manual release of a garage door opener from outside the garage.

When constructing a building, care is taken to ensure that access is provided to authorized occupants, while unauthorized persons are deterred or otherwise prevented from entry. A thief or would-be wrongdoer, seeking entry into a building, will look for the "weakest link" in the building's security. Since only one weakness is required to gain entry, whichever entry point or security system that is most easily defeated will be attacked and exploited.

Garage doors often create several possibilities for a breach of security. One technique of gaining unauthorized access involves simply rolling the door upward, using its own tracks and rollers to make the thief's job easier. U.S. Pat. No. 5,533,561 to Forehand sought to make the garage door more secure by automatically inserting a locking pin into the trackway to prevent the door from being moved more than a few inches. Locking devices are somewhat problematic, in that they can prevent the door from being opened in an emergency, during a power failure, or when the opener simply fails.

Consequently, garage doors with locking devices such as that proposed by Forehand also now include a release mechanism to allow the door to be manually opened in case of a power failure or other emergency. Accordingly, most garage door openers today include a release lever, which acts to release the locking mechanisms or release the garage door drive train so that it can be manually operated. These release levers are standardly provided near the door itself, and are typically operated by simply pulling a string which dangles beneath the release lever.

However, these release mechanisms themselves have created considerable opportunity for a security breach. Many garage doors close leaving a small space immediately above the door, between the door frame and uppermost door section. This space is often covered with a rubber gasket. But, this space is often large enough to allow a thin item to be inserted into the garage from outside. Accordingly, it is quite possible for an unauthorized person to stand outside of the garage, reach into the garage with a hooked wire such as a coat hanger, and operate the garage door opener release mechanism. With practice, unauthorized access can be gained in seconds. Thus, it can be said that the manual-override release mechanisms of current garage door openers now provide a "weak link" in the security of millions of dwellings in the United States alone.

SUMMARY OF THE INVENTION

It is an object of the invention to produce a garage door opener security system which prevents unauthorized access to a garage by using the opener's own release mechanism. Accordingly, the security system prevents unauthorized access by preventing unauthorized use of the release mechanism.

It is another object of the invention to provide a garage door opener security system which is inexpensive to manufacture. Accordingly the invention simply involves two security plates, which extend downward adjacent to the release levers, on both sides thereof, preventing unauthorized access to said release lever.

It is another object of the invention to provide a garage door opener security system which is easy to install, and which is readily adaptable to existing garage door opener designs. Accordingly, employing simplistic mounting techniques, the security plates can be easily installed onto the truck or onto the track immediately adjacent to the truck when the door is in the closed position.

The invention is a garage door opener security system, for preventing the unauthorized opening of a garage door, mounted within a dwelling. The garage door opener has a track mounted to the dwelling, and a truck slidably mounted on the track which is operatively engaged with the door. A release lever extends downward from the truck to allow manual release and opening of the garage door. The security system prevents unauthorized operation of the release lever by providing a pair of security plates which extend downward from the truck on either side of the release lever. The security plates thereby prevent an unauthorized person from extending an object into the garage from outside in an attempt at operating the release lever.

To the accomplishment of the above and related objects the invention may be embodied in the form illustrated in the accompanying drawings. Attention is called to the fact, however, that the drawings are illustrative only. Variations are contemplated as being part of the invention, limited only by the scope of the claims.

BRIEF DESCRIPTION OF THE DRAWINGS

In the drawings, like elements are depicted by like reference numerals. The drawings are briefly described as follows.

DETAILED DESCRIPTION OF THE PREFERRED EMBODIMENTS

Figure 1:
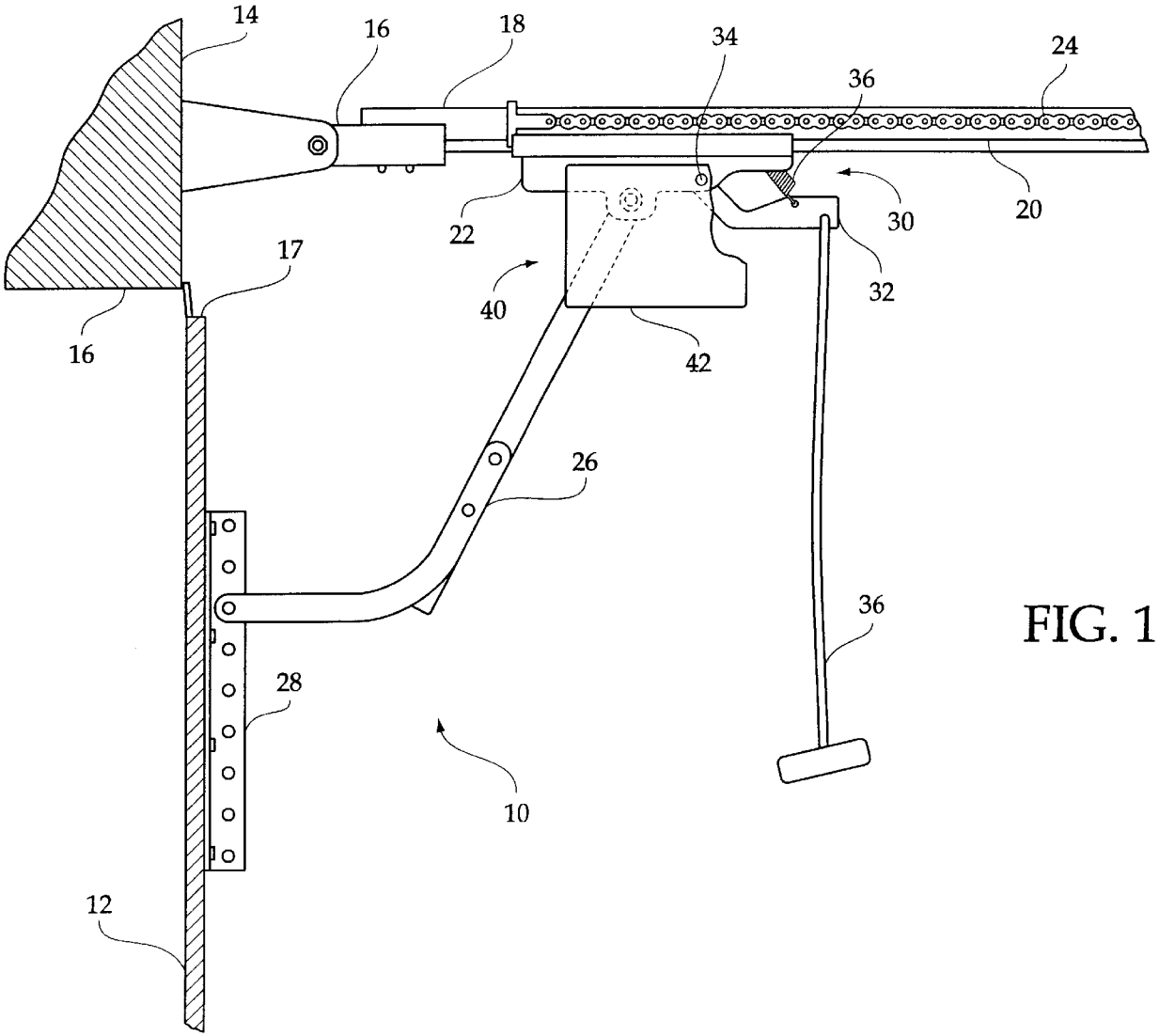
FIG. 1 is a side elevational view of a typical garage door opener system, with the security system of the present invention installed thereon.

FIG. 1 illustrates a garage door opener system 10, comprising a garage door 12 installed within a dwelling 14. The dwelling 14 includes a door frame header 16. A garage door opener 16 is anchored to the dwelling, and is operatively engaged with the garage door 12 to allow the garage door to open and close. A small space is present between the garage door 12 and door frame header 16. A rubber strip 17 extends in this space to prevent moisture from entering the garage therethrough.

Figure 2:
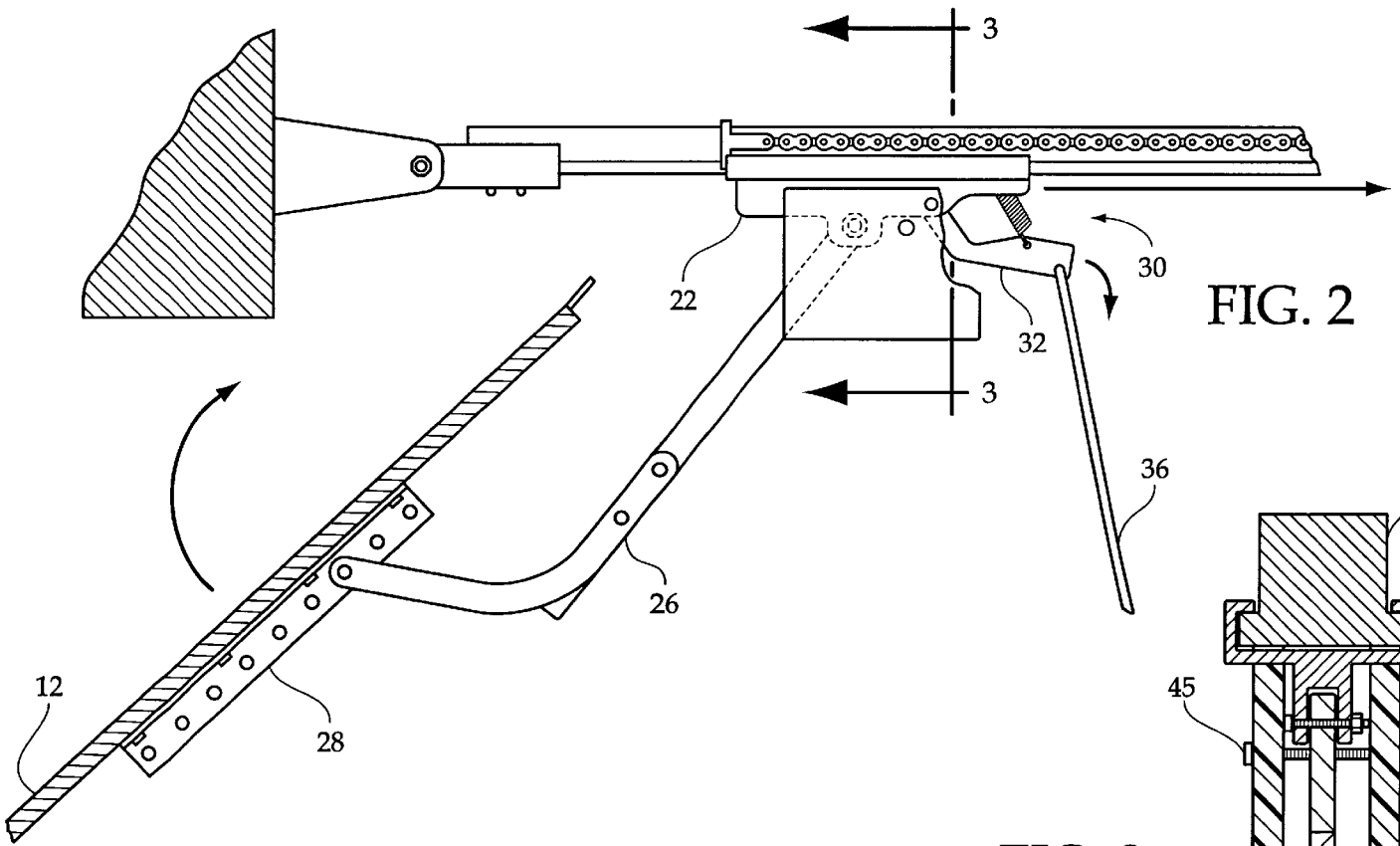
FIG. 2 is a side elevational view, illustrating operation of the garage door opener, showing the typical use of the release lever.

The garage door opener 16 includes a drive train 18, which includes a track 20, a truck 22 slidably mounted on the track 20, and a power source 24 which pulls the truck 22 rearward to open the garage door 12. Accordingly, the truck 22 is attached to the garage door by means of a main arm 26. The main arm 26 is attached to the garage door with a vertical bracket 28, such that the main arm is pivotally attached at both the vertical bracket 28 and the truck 22. Referring momentarily to FIG. 2, when the garage door is opened, the main arm 26 must pivot at both the vertical bracket 28 and the truck 22 to ensure the door 12 can pivot rearward.

Also shown in FIG. 1 and 2 is a release mechanism 30, which comprises a release arm 32 which is pivotally mounted to the truck 22 at a pivot axle 34. A release spring 36 connects the release arm 32 to the truck 22 and biases the release arm 32 toward the truck 22, causing the release arm 32 to return to its initial position once it has been pulled downward.

To operate the release arm 32, it must be pulled downward from a point opposite the pivot axle 34. However, in a typical garage installation, the release arm is located approximately six or seven feet above the garage floor. Accordingly, a release cord 36 is often attached to the release arm 32 fully opposite from the pivot axle 34 to allow a person standing inside the garage to easily operate the release arm 32.

As previously indicated, the release arm 32 not only provides a convenient way for the user to manually open the garage door 12, but also provides an opportunity for an unauthorized person to reach into the garage door through the small space above the garage door using a hooked item and operate the release arm 32. According to the present invention, then, a security system 40 is provided to prevent an unauthorized person from operating the release arm 32.

As illustrated in FIG. 1 and FIG. 2, the security system 40 comprises a pair of security plates 42 which extend vertically alongside the release arm 32, and thereby prevent an item from reaching the release arm from the side.

Figure 3:
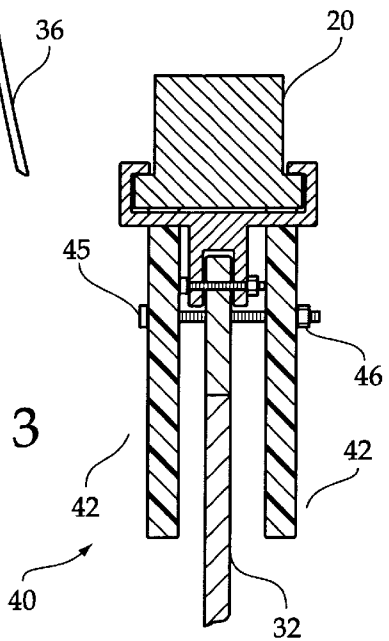
FIG. 3 is a cross sectional view, illustrating the release lever protected on both sides by the security plates.

Referring now to FIG. 3, in order to extend alongside the release arm, the security plates 42 preferably extend downward from the truck 22 alongside the release arm 32, and are mounted to the truck 22 using one or more bolt 45 and nut 46 fastening systems. As illustrated, the bolt 45 and nut 46 can be used to tension the security plates 42 against the truck 22, squeezing the truck 22 without the need to extend the bolt 45 through the truck 22 itself. However, the security plates 42 can also be attached to the track 20, such that the release arm 32 would be positioned between the security plates 42 when the door is fully closed and thus the truck 22 would rest in position between the security plates 42.

In conclusion, herein is presented a system for effectively preventing the unauthorized release of a garage door opener by preventing access to the manual release arm of said garage door opener. The invention is illustrated in FIG. 1 through 3 with an example of the inventive concept. However, numerous variations are possible but are considered part of the same inventive concept.

What is claimed is:

1. A security system, for preventing unauthorized access to a dwelling in combination with a garage door and a garage door opener, the garage door opener having a track, a truck slidably mounted on the track, an operating means and a release lever located beneath the truck and extending downward therefrom for manually releasing the garage door from the operating means, comprising:

a pair of security plates, extending alongside the release lever, preventing access to the lever from the side thereof the security plates are secured to the truck and are tensionable thereagainst.

2. The security system as recited in claim 1, wherein the security plates extend downward from the truck on either side of the release lever.

3. The security system as recited in claim 2, wherein the security plates secure to the truck with a bolt and nut arrangement which attaches between the security plates, tensions the plates tightly against the truck, but said bolt and nut does not extend through the truck.

* * * * *